US005581809A

United States Patent [19]

Mah

[11] Patent Number: 5,581,809

[45] Date of Patent: Dec. 10, 1996

[54] PROTECTIVE GLOVE

[76] Inventor: Jung Y. Mah, 251 Parkview Ave., Willowdale, Ontario, Canada, M2N 3Z3

[21] Appl. No.: 534,271

[22] Filed: Sep. 26, 1995

[51] Int. Cl.[6] ..... A41D 13/10

[52] U.S. Cl. ..... 2/20; 2/161.1

[58] Field of Search ..... 2/16, 167, 20, 2/161.1, 161.6, 162, 168, 159

[56] References Cited

U.S. PATENT DOCUMENTS

| | | | |
|---|---|---|---|
| 4,051,553 | 10/1977 | Howard | 2/20 |
| 4,748,690 | 6/1988 | Webster | 2/20 X |
| 4,864,660 | 9/1989 | Sawyer | 2/167 X |
| 5,018,221 | 5/1991 | Romandetto | 2/20 X |
| 5,214,799 | 6/1993 | Fabry | 2/20 X |
| 5,257,418 | 11/1993 | Jaskeiwicz | 2/20 |
| 5,404,591 | 4/1995 | Brinnand et al. | 2/20 |

FOREIGN PATENT DOCUMENTS

| | | | |
|---|---|---|---|
| 2546346 | 4/1977 | Germany | 2/20 |

*Primary Examiner*—Paul C. Lewis
*Attorney, Agent, or Firm*—Patrick J. Hofbauer

[57] ABSTRACT

A protective glove is formed of the type having a back portion, a palmar portion and a plurality of digital sheaths distally projecting from between the back and palmar portions for use on the hand of a wearer. The human hand has a proximal transverse palmar crease, a distal transverse palmar crease and a longitudinal thenar crease all positioned on the palmar surface of said hand. The improvement disclosed comprises the provision of a plurality of flexible resilient pads for absorbing shock positioned on the palmer portion of the glove in spaced, non-overlapping relation to each other and in adjacent substantially non-overlapping relation to the proximal digital crease, the distal transverse palmar crease and the longitudinal thenar crease, such that the plurality of flexible resilient pads abut one-another in edge-contacting relation upon flexion of the hand to form a substantially continuous, non-creased shock absorbing layer covering the metacarpal region of the hand.

15 Claims, 3 Drawing Sheets

PROTECTIVE GLOVE

FIELD OF THE INVENTION

The present invention relates to protective gloves, and more particularly to protective gloves for use in sports or occupational applications where the hands of the wearer are exposed to high frictional loads or are made weight bearing over prolonged periods, such as in the sports of weight-lifting or long-distance cycling.

BACKGROUND OF THE INVENTION

The use of protective gloves having impact absorbing protective padding on the palms thereof is well known. One such glove (disclosed in U.S. Pat. No. 4,561,122, Stanley et al.) is constructed from a shock absorbent material and has a palmar metacarpal pad which covers the entire palmar area between the wrist and the second, third, fourth and fifth metacarpophalangeal joints, excluding the surface of the thenar eminence, the mound at the base of the thumb, such pad Comprising a double thickness of glove material.

A common problem encountered in using prior art protective gloves, including that of Stanley et al., is the development of blisters on the gloved hands of the wearer. Ordinarily, there is a certain amount of bulkiness associated with the addition of protective padding to the palmar area of a glove. This bulkiness can have the effect of interfering with the natural contours of the folded hand. Furthermore, the position of the stitching lines which secure the protective padding to the palmar surface of the glove are often the result of random selection, economies of manufacture, or are selected for aesthetic appeal, (for example stitching lines in quilted flower patterns have been used in order to maximize the consumer attractiveness of the gloves). The palmar surface of such protective gloves will fold in response to flexion of the wearer's hand for gripping objects, but the manner and location of such folding is arbitrarily determined in the prior art by the peculiarities of construction of the glove itself, and not by the physiology of the wearer's hand. In other words, the fold locations of the palmar material of the glove will not necessarily correspond to the natural fold lines of the skin of the wearer's palm, but will instead place constriction upon the wearer's palm in positions which are unnatural to the folded human hand. When such constrictions are frequently applied and released (as in repeated flexion of the hand), or are accompanied by the application of significant pressure, such as in industrial applications or in the sport of weight lifting, then the soft tissues of the wearer's palm experience trauma, typically resulting in blistering of the wearer's skin in areas underlying the folds of the glove.

Furthermore, if the wearer puts significant stress upon the heel of the hand, either as a result of repetitive impacts (vibrational or otherwise) or as a result of long term weight bearing (in situations such as cycling), then injury to the median nerve of the hand may occur. The median nerve travels through an anatomic space at the base of the palm of the hand known as the carpal tunnel. If external pressure is applied to the carpal tunnel, then such pressure is transmitted to the median nerve and, over time may result in injury which is experienced as numbness and tingling of the thumb, index, middle, and part of the ring fingers of the hands. This phenomenon is know as repetitive stress injury, or Carpal Tunnel Syndrome.

Frequently, individuals will wear padded gloves in an effort to lessen the force and frequency of pressures to the carpal tunnel area. Conventional padded gloves may provide some relief from trauma to the wrist area generally; however, prior art protective gloves have failed to take into account the subtleties of the structure of the carpal tunnel region. Accordingly, the wearing of conventional padded protective gloves may even have the effect of exacerbating Carpal Tunnel Syndrome, since the additional padding found in conventional padded protective gloves may have the effect of increasing the resultant pressure upon the carpal tunnel, even as it protects the hand generally.

It is an object of the present invention to provide a padded protective glove that not only protects the most vulnerable areas of the wearer's hand from impact and frictional trauma, i.e., the heel, the palm and the frontal, proximal areas of the fingers, but also protects the wearer's hand from soft tissue damage caused by incompatibility between the protective padding present in the palmar area of prior art protective gloves, and the underlying anatomical structures of the wearer's hand.

More particularly, it is an object of the present invention to provide a padded protective glove which avoids injurious contact between protective palmar padding of the glove and the soft tissues of the wearer's hand by conforming such protective padding to the contours of the wearer's palm during flexion thereof.

It is a further object of the present invention to provide a padded protective glove which will fold in the same locations as the natural palmar creases of the wearer's hand.

It is yet a further object of the present invention to provide a protective glove which lessens the severity of pressures applied to the carpal tunnel of the wearer's hand, and thus lessens the risk of potential trauma to the median nerve.

SUMMARY OF THE INVENTION

In accordance with the present invention there is disclosed an improvement to a protective glove of the type having a back portion, a palmar portion and a plurality of digital sheaths distally projecting from between the portions for used on the hand of a wearer. The palm of the human hand naturally bears a proximal digital crease, a distal transverse palmar crease and a longitudinal thenar crease. The improvement comprises a plurality of flexible means for absorbing shock positioned on the palmer portion of the glove in spaced, non-overlapping relation to each other and in adjacent substantially non-overlapping relation to the proximal digital crease, the distal transverse palmar crease, and the longitudinal thenar crease of the hand of a wearer. The plurality of first flexible means comprises a substantially tapered, shock absorbing, resilient pad positioned on the palmar portion distal to and adjacent to the distal transverse palmar crease of the hand of a wearer, a substantially elongate, shock absorbing, resilient pad having two curved ends and a narrowed region between the two curved ends, the elongate pad being positioned on the palmar portion adjacent to and between the distal transverse palmar crease and the proximal transverse palmar crease of the hand of a wearer, a substantially tear-drop-shaped, shock absorbing, resilient pad positioned on the palmar portion proximal to and adjacent to the proximal transverse palmar crease, and ulnar to and adjacent the longitudinal thenar crease of the hand of a wearer, and a substantially rectangular, shock absorbing, resilient pad positioned on the palmar portion proximal to and adjacent to the longitudinal thenar crease of the hand of a wearer. The plurality of flexible means for absorbing shock abut one another in edge-contacting relation upon flexion of the hand to form a substantially continuous, non-creased shock absorbing layer covering the metacarpal region of the hand. A second means for absorbing shock is comprised of a resilient carpal pad positioned on the palmar portion of the glove at a location which overlies the carpal region of the hand. The resilient carpal pad has a portion of reduced thickness centrally positioned in overlying relation to the carpal tunnel of the hand.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

DETAILED DESCRIPTION OF A PREFERRED EMBODIMENT

Figure 1:
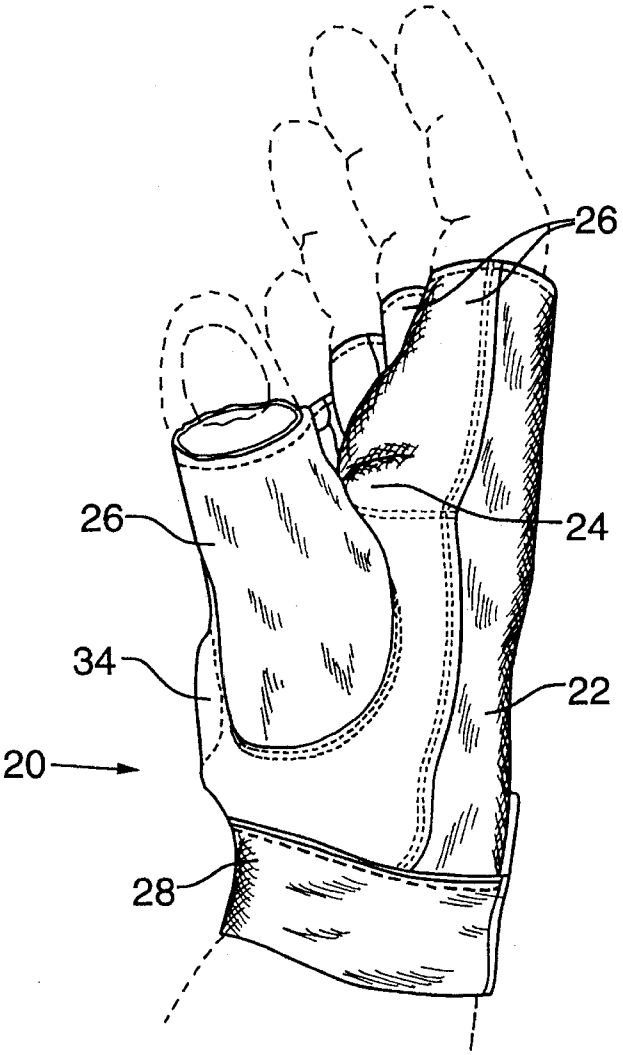
FIG. 1 of the drawings appended hereto is a diagrammatic perspective view of a protective glove according to a preferred embodiment of the invention, worn on the hand of a wearer, said hand shown in phantom outline.

Referring now to FIG. 1 of the drawings, a protective glove according to a preferred embodiment of the present invention, designated by general reference numeral 20, is shown on the hand of a wearer (indicated in phantom outline). The basic structure of the glove is conventional; having a back portion 22, a palmar portion 24, and a plurality of digital sheaths 26 distally projecting from between the back portion 22 and the palmar portion 24. The back portion 22, palmar portion 24 and digital sheaths 26 may all be constructed form a resilient textile fabric. A preferred fabric is spandex nylon stretchable textile fabric. It is additionally possible to construct the palmar portion from a thicker resilient fabric which has a nap to create some frictional resistance between the palmar portion of the glove and other equipment to be grasped by the wearer's hand (for example bicycle handle bars). A wrist band portion 28 is securely attached to the back portion 22 and the palmar portion 24. The wrist band portion 28 can fitted with a cooperation releasable fastening means 30 to permit the wrist band portion to be adjustably, releasably closed around the wrist of the wear. A conventional fastening means such as hook and loop fastening would be acceptable for this purpose.

Figure 2:
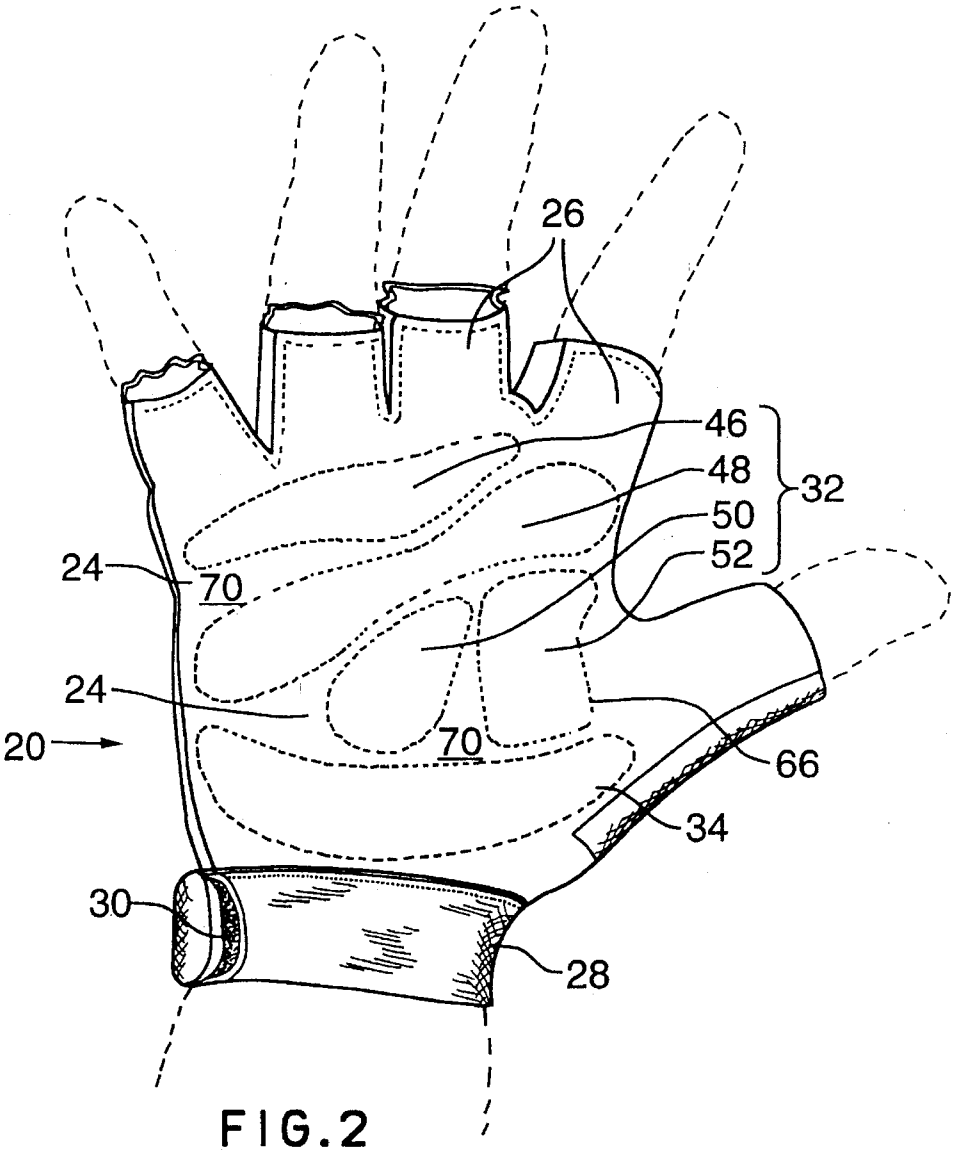
FIG. 2 of the drawings is a plan view of the palmar surface of the protective glove of FIG. 1.

The improvement of the present invention over prior art protective gloves lies in the positioning and composition of a plurality of flexible means for absorbing shock. Referring now to FIG. 2, a plurality of first flexible means for absorbing shock 32 are positioned on the palmer portion 24 of protective glove 20 in spaced, non-overlapping relation to one another. In particular, the plurality of first flexible means for absorbing shock 32, being four resilient pads distributed in the metacarpal area of the palmar portion 24 of glove 20, are positioned in spaced relation adjacent to, but substantially not overlapping, the major creases of the hand. A further crescent shaped resilient carpal pad 34, is positioned on the palmar portion 24 of the glove 20 in the carpal area of the hand.

Figure 3:
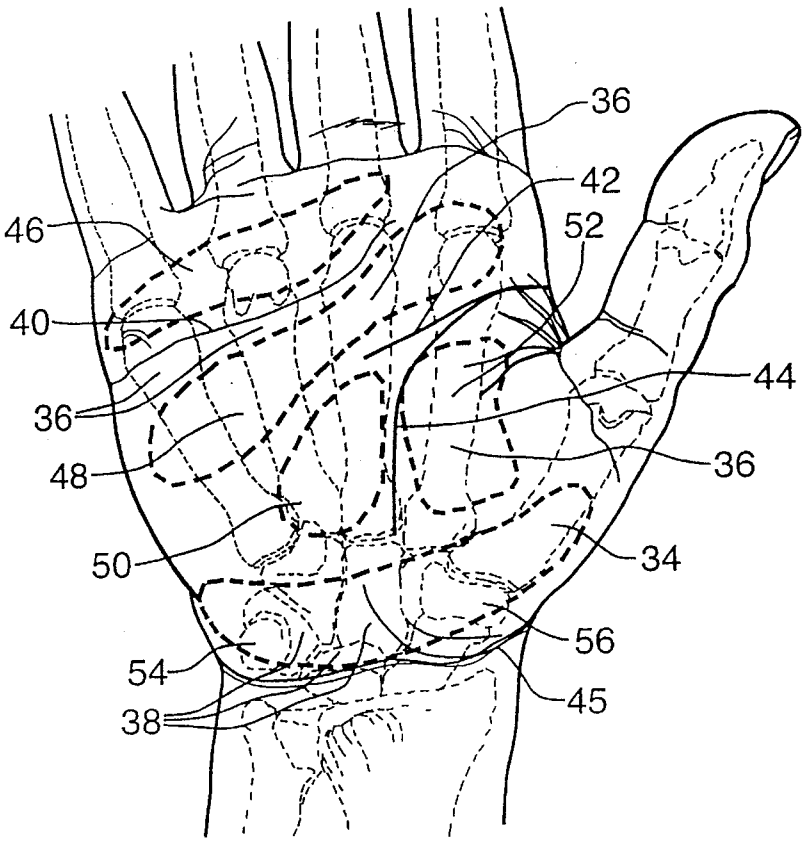
FIG. 3 of the drawings is a diagrammatic representation of the palmar surface of a human hand showing the major creases of the human hand, the corresponding location of the underlying bones of the hand in phantom outline, and having superimposed thereon a representation in dotted outline of the relative positions of the plurality of means for absorbing shock of the preferred embodiment of the protective glove of the present invention.

Referring to FIG. 3, the bones of the human hand are shown in phantom outline. The groups of bones which are covered by the glove of the present invention are the metacarpals 36, being the bones of the mid portion of the hand, and the carpals 38, being the small bones of the heel of the hand and the wrist. The major crease lines of the hand are as follows: the distal transverse palmar crease 40, the proximal transverse palmar crease 42, and the longitudinal thenar crease 44, and the distal crease of the wrist 45.

In the preferred embodiment of the present invention, the plurality of first flexible means for absorbing shock, collectively indentified by numeral 32, and the resilient carpal pad 34 take the form of resilient pads constructed from a resilient impact absorbing material. Materials such as natural or synthetic rubber; natural or synthetic rubber foams, with either open or closed cell structures; polymeric foams, with either open or closed structures, (including but not limited to polyurethane foams and polystyrene foams); and conventionally available impact absorbent gels, which may or may not require a pliable membrane containment pouch may be for construction of the resilient pads. A preferred resilient impact absorbing material is a synthetic rubber foam material available under the trade mark VISCOLAS™ from Cabot Corporation, of Waltham, Mass., U.S.A.

Figure 4:
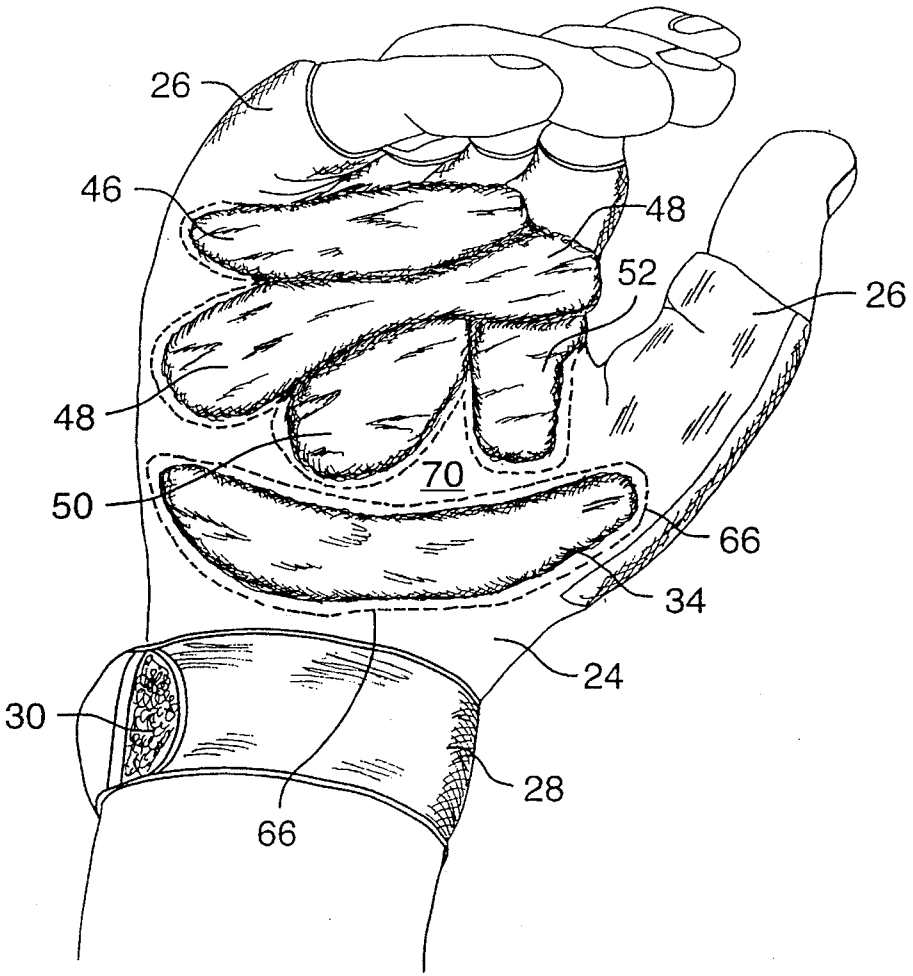
FIG. 4 of the drawings is a perspective view of the protective glove of FIG. 2, shown on a hand of a wearer, which hand is in a flexed position.

Referring to FIGS. 2 and 3, the four resilient pads are positioned on the palmar portion of the glove as follows. A substantially tapered pad 46 is positioned distal to and adjacent the distal transverse palmar crease 40. The tapered pad 46 is positioned to overlay and protect the metacarpophalangeal joints of three fingers of the hand. A substantially elongate pad 48 having two curved ends and a narrowed region between said two curved ends is positioned adjacent to and between the distal transverse palmar crease 40 and the proximal transverse palmar crease 42. The elongate resilient pad overlays the metacarpophalangeal joint of the index finger and extends obliquely toward the wrist, to overlay and protect a section of the metacarpal bones of each finger. Neither one of tapered pad 46 or elongate pad 48 overlaps the other pad, nor substantially overlaps any one of the major creases of the hand. As best illustrated in FIG. 4, when the hand is in flexion, the tapered pad 46 and the elongate pad 48 are brought in to abutting contact with one another and the non-padded area of the palmar portion which lies between tapered pad 46 and elongate pad 48 will be folded into the distal transverse palmar crease 40 of the hand of the wearer. A substantially tear-drop shaped resilient pad 50 is positioned on the palmar portion 24 of the protective glove 20 proximal to and adjacent the proximal transverse crease 42, and ulnar to and adjacent the longitudinal thenar crease 44 of the hand. A substantially rectangular resilient pad 52 is positioned on the palmar portion 24 of the protective glove 20 proximal to and adjacent the longitudinal thenar crease 44.

As shown in FIG. 4, when the wearer's hand is in flexion, the distal edges of both the substantially tear-drop shaped resilient pad 50 and the substantially rectangular resilient pad 52 are brought into abutting contact with the proximal edge of the elongate resilient pad 48, forcing the non-padded area of the palmar portion, which lies between the resilient pads 50, 52, and 48, to be folded into the proximal transverse palmar crease of the wearer's hand. Similarly, the radial edge of the substantially tear-drop shaped resilient pad 50 is brought into abutting contact with the ulnar edge of the substantially rectangular resilient pad 52, causing the non-padded area of the palmar portion lying therebetween to be folded into the longitudinal thenar crease of the hand. Thus, during flexion of the hand all four of resilient pads 46, 48, 50, and 52 are brought into edge-contacting relation to form a substantially, continuous non-creased shock absorbing layer covering the metacarpal region of the hand. The combination of padded and non-padded areas of the palmar portion of the protective glove generate natural regions along which the protective glove will tend to fold in response to flexion of the hand. In consequence of the positioning of the resilient pads adjacent to the major creases of the human hand, the protective glove will fold at positions which correspond to the natural crease lines of the hand, and thus will not constrict the hand of the wearer at locations which are unnatural to the folded contours of the human hand. Accordingly, there is never a instance where the bulk of a resilient pad is pressed into the palm of the hand in a folded manner. Instead, only non-padded resilient textile areas of the palmar portion of the glove will be pressed into the palm of the wearer's hand, and then only at the locations of the major crease lines of the palm of the hand, where natural folding of the palmar surface of the hand will occur in any event during flexion.

A second flexible means for absorbing shock comprising the resilient carpal pad 34 is positioned on the palmar portion of the glove adjacent the distal crease of the wrist 45. The resilient carpal pad 34 is substantially crescent shaped. As shown in FIG. 3, the resilient carpal pad 34 overlies certain of the carpal bones 38 which form the underlying anatomical support of the wrist. The portion of the hand commonly referred to as the heel results from the musculature in this area which interacts with the carpal bones 38. In particular, the resilient carpal pad 34 overlies two bony protrusions of the carpal bones, the pisiform 54 and the tubercle of scaphoid 56.

Figure 6:
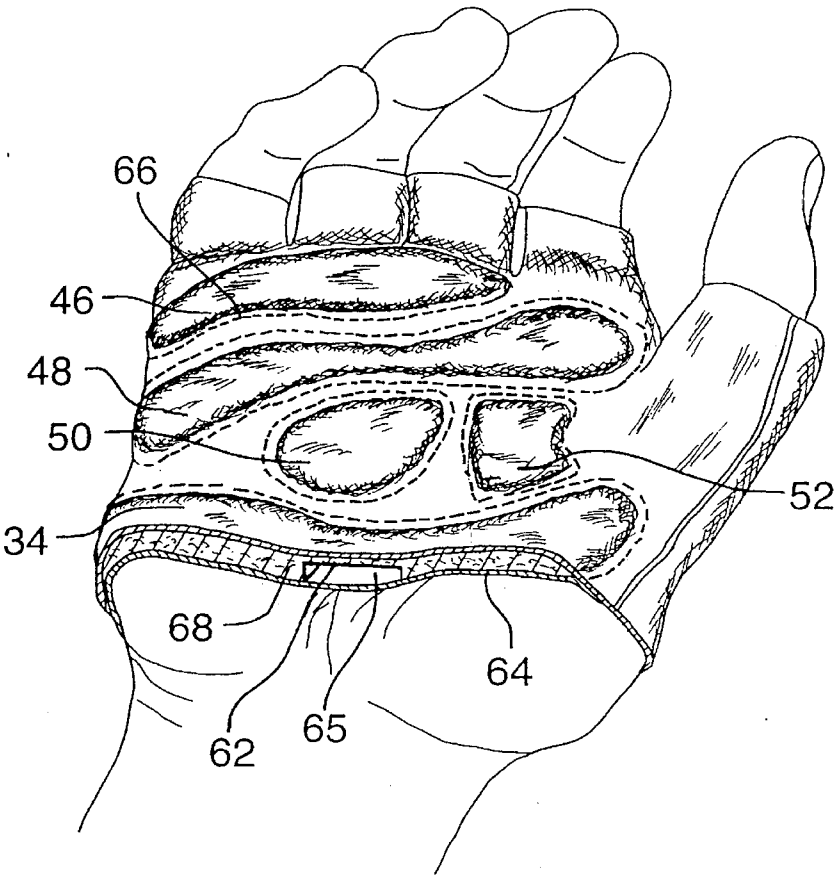
FIG. 6 of the drawings is a perspective view of the palmar surface of the protective glove of FIG. 1, having a portion thereof cut away to reveal detail of the interior structure of the glove in cross-section.
Figure 5:
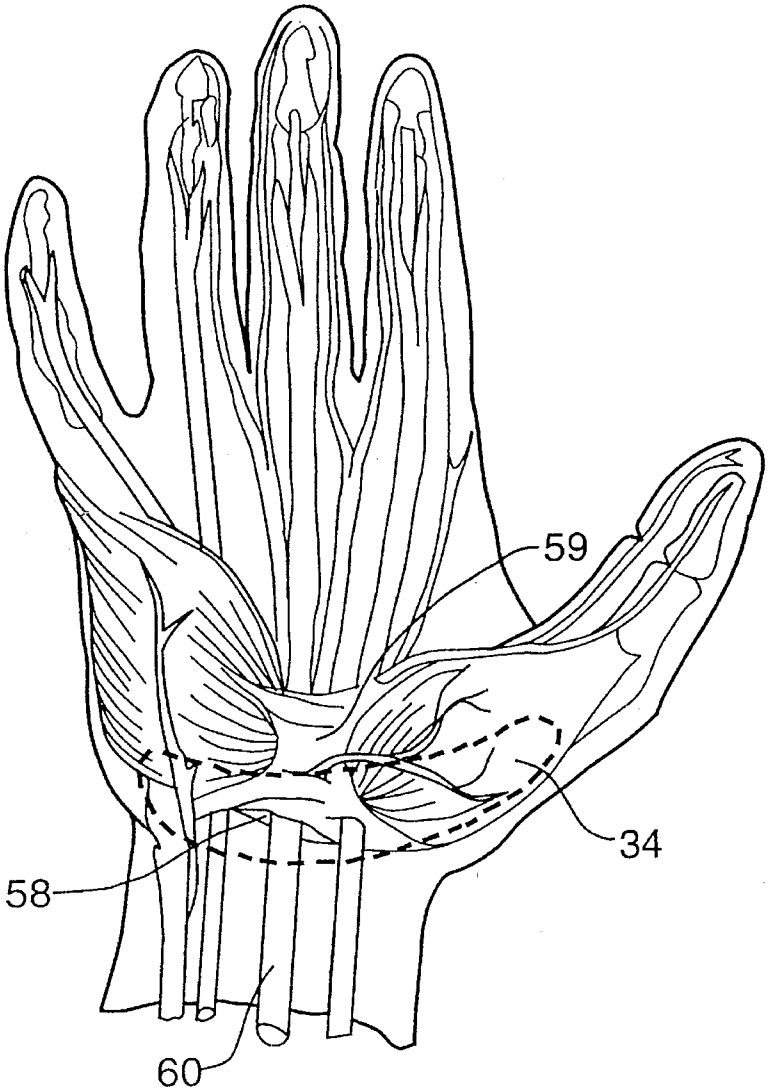
FIG. 5 of the drawings is a diagrammatic representation of the musculature and nerve distribution of the palmar region of the human hand and having a representation of the relative position of the resilient carpal pad superimposed thereon.

The resilient carpal pad 34 has a dual function. First, resilient carpal pad 34 protects the small carpal bones from physical shock. Secondly, the resilient carpal pad 34 is adapted to protect the structure commonly known as the carpal tunnel 58 from pressure, either in the form of repeated (vibrational) impact or from constant pressure, such as would occur if the heels of the hands were made weight bearing (as in weightlifting or long distance cycling). The carpal tunnel 58 (best illustrated in FIG. 5) is a fibro-osseous canal near the palmar surface of the heel of the hand. The base of the carpal tunnel 58 supported by the surface of the carpal bones, and the roof of the carpal tunnel is formed by a transverse carpal ligament 59. The median nerve 60 travels along the forearm, passes through the carpal tunnel 58 and subsequently branches to bring sensation to the fingers and thumb. As shown in dotted outline in FIG. 5, the resilient carpal pad 34 overlies the carpal tunnel 58. The resilient carpal pad 34 has been constructed in a manner which is designed to relieve pressure on the carpal tunnel. First, the resilient carpal pad 34 is supported upon the pisiform 54 and the tubercle of scaphoid 56, two bony protuberances which project above the carpal tunnel 58, at either side thereof. Thus, a considerable amount of pressure which, in the course of sporting or occupational activity would be applied to the carpal tunnel region, will be absorbed by the resilient carpal pad 34 and directed to the supporting structures, the pisiform 54 and the tubercle of scaphoid 56. The resilient carpal pad 34 is further adapted to create a bridge over the carpal tunnel 58, so that no object will directly impinge upon the carpal tunnel 58 while the glove is worn. As best illustrated in the cut away portion of FIG. 6, this bridge is created by means of a portion of reduced thickness 62 in the resilient carpal pad 34 positioned to overlay the carpal tunnel 58. The portion of reduced thickness 62 is positioned in spaced relation from the wearer's wrist, forming a hollow channel 65, which hollow channel 65 is bridged by the substantially rectangular-shaped portion of reduced thickness 62. The portion of reduced thickness 62 is approximately one half of the thickness of the remainder of the resilient carpal pad 34. In the preferred embodiment illustrated, the portion of reduced thickness 62 is approximately ⅛ inch thick and the remainder of the resilient carpal pad 34 is approximately ¼ inch thick.

All of the resilient pads 34, 46, 48, 50, 52, may effectively be positioned on the palmar portion 24 of the protective glove 20 and attached thereto by conventional means, such as gluing or stitching. In the preferred embodiment of the present invention, a resilient fabric lining layer 64 underlies the palmar portion 24. The resilient pads 34, 46, 48, 50, and 52 are all respectively positioned on an inner surface 68 of the palmar portion 24, in juxtaposed intervening relation to the fabric lining layer 64 and the palmar portion 24. The fabric lining layer 64 is then attached to the palmar portion 24 by conventional stitching 66. This conventional stitching 66 surrounds each of the resilient pads 34, 46, 48, 50, and 52 since the stitching lines are directed adjacent the entire perimeter of each resilient pad. The resilient pads 34, 46, 48, 50, and 52 are retained between the palmar portion 24 and the lining 64 in the positions as previously described above. The interlayering of the resilient carpal pad 34 between the palmar portion 24 and the lining 64 is best seen in the cutaway portion of FIG. 6. On an exposed surface 70 of the palmar portion 24, the lines of conventional stitching 66 which attach the fabric lining 64 to the palmar portion 24 demarcate the presence of the resilient pads 34, 46, 48, 50, and 52. The contours of the raised resilient pads appear on the surface of the palmar portion 24, though the resilient pads themselves are not actually visible when the protective glove is worn.

In the preferred embodiment of the present invention as described above, the protective glove is designed for optimal comfort and effectiveness. It will be obvious to those skilled in the art that other shock absorbent materials could be substituted for the preferred synthetic rubber material discussed above.

Also, the protective glove can either be constructed with partial digital sheaths as shown, or with extended and closed digital sheaths to completely encase the fingers. Additionally, any advantageous combination of enclosed and partial sheaths could be used in order to facilitate the specific needs of a wearer in instances where exposure of selected finger tips is required. Thus, it will be apparent that the scope of the present invention is limited only by the claims set out hereinbelow.

I claim:

1. In a protective glove of the type having a back portion, a palmar portion and a plurality of digital sheaths distally projecting from between said portions for use on the hand of a wearer, said hand having a proximal transverse palmar crease, a distal transverse palmar crease, a proximal digital crease, and a longitudinal thenar crease all positioned on the palmar surface of said hand, the improvement comprising:

a plurality of first flexible means for absorbing shock said plurality of first flexible means being comprised of:

a substantially tapered, shock absorbing, resilient pad positioned on the palmar portion distal to and adjacent to the distal transverse palmar crease of the hand of a wearer;

a substantially elongate, shock absorbing, resilient pad having two curved ends and a narrowed region between said two curved ends, said elongate pad being positioned on the palmar portion adjacent to and between the distal transverse palmar crease and the proximal transverse palmar crease of the hand of a wearer;

a substantially tear-drop shaped, shock absorbing, resilient pad positioned on the palmar portion proximal to and adjacent to the proximal transverse palmar crease, and ulnar to and adjacent the longitudinal thenar crease of the hand of a wearer; and, a substantially rectangular shock absorbing resilient pad positioned on the palmar portion proximal to and adjacent to the longitudinal thenar crease of the hand of a wearer;

such that said plurality of means abut one-another in edge-contacting relation upon flexion of the hand to form a substantially continuous, non-creased shock absorbing layer covering the metacarpal region of said hand.

2. The protective glove of claim 1, further comprising a second flexible means for absorbing shock comprised of a resilient carpal pad positioned on the palmar portion at a location which overlies the carpal region of the hand, said resilient carpal pad having a portion of reduced thickness centrally positioned in overlying relation to the carpal tunnel of said hand.

3. The protective glove of claim 2, wherein the portion of reduced thickness of the resilient carpal pad is positioned in spaced relation from the wrist of a wearer.

4. The protective glove of claim 3, wherein said portion of reduced thickness is approximately one half of the thickness of the remainder of the resilient carpal pad.

5. The protective glove of claim 4, wherein the portion of reduced thickness is approximately ⅛ inch thick and the remainder of the resilient carpal pad is approximately ¼ inch thick.

6. The protective glove of claim 2 wherein the shock absorbing resilient pads are constructed from a slow-recovery, shock absorbing material.

7. The protective glove of claim 6, wherein the slow-recovery, impact-absorbing material is synthetic rubber material.

8. The protective glove of claim 7, wherein the synthetic rubber material is a synthetic rubber foam.

9. The protective glove of claim 2, further comprising a resilient fabric lining layer underlying the palmar portion, with said plurality of first flexible means for absorbing shock and said second flexible means for absorbing shock respectively positioned on said palmer portion as aforesaid in juxtaposed intervening relation to said fabric lining layer and said palmar portion.

10. The protective glove of claim 9, wherein the fabric lining layer is attached to the palmar portion by conventional stitching, which stitching surrounds said plurality of first flexible means for absorbing shock and said second flexible means for absorbing shock to retain said plurality of first flexible means and said second flexible means on the palmar portion in their respective positions as aforesaid.

11. The protective glove of claim 1, further comprising a wrist band portion securely attached to said back portion and said palmar portion.

12. The protective glove of claim 11, further comprising cooperating releasable fastening means on said wrist band portion to permit the wrist band portion to be adjustably, releasably closed around the wrist of a wearer.

13. The protective glove of claim 1 wherein the back portion, the digital sheaths and the palmar portion are constructed from a resilient textile fabric.

14. The protective glove of claim 13, wherein the resilient textile fabric is spandex nylon stretchable textile fabric.

15. In a protective glove of the type having a back portion, a palmar portion and a plurality of digital sheaths distally projecting from between said portions for use on the hand of a wearer, the improvement comprising:

a flexible means for absorbing shock comprised of a resilient carpal pad positioned on the palmar portion at a location which overlies the carpal region of the hand, said resilient carpal pad having a portion of reduced thickness centrally positioned in overlying relation to the carpal tunnel of said hand.

* * * * *